US007594652B2

(12) United States Patent
Schalk et al.

(10) Patent No.: US 7,594,652 B2
(45) Date of Patent: Sep. 29, 2009

(54) SEPARATION SYSTEM

(75) Inventors: Wesley R. Schalk, Camas, WA (US); Allan G. Olson, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 122 days.

(21) Appl. No.: 11/669,930

(22) Filed: Jan. 31, 2007

(65) Prior Publication Data

US 2008/0179817 A1 Jul. 31, 2008

(51) Int. Cl.
*B65H 3/06* (2006.01)

(52) U.S. Cl. ..... 271/117; 271/124; 271/125; 271/118; 271/10.12

(58) Field of Classification Search ..... 271/10.02, 271/10.03, 10.09, 10.11, 10.12, 10.13, 122, 271/124, 125, 242, 117, 118
See application file for complete search history.

(56) References Cited

U.S. PATENT DOCUMENTS 5,181,712 A 1/1993 Perino et al.
5,222,724 A * 6/1993 Hirano et al. ..... 271/10.11
5,358,230 A * 10/1994 Ikemori et al. ..... 271/114
5,423,526 A * 6/1995 Hasegawa ..... 271/10.13
5,427,462 A 6/1995 Jackson et al.
5,491,567 A 2/1996 Morikawa et al.
5,573,338 A 11/1996 Morikawa et al.
5,606,430 A 2/1997 Morikawa et al.
5,622,364 A * 4/1997 Dutton et al. ..... 271/117
5,624,196 A 4/1997 Jackson et al.
5,730,537 A 3/1998 Kelly et al.
5,755,435 A 5/1998 Fujiwara
6,142,467 A * 11/2000 Funada ..... 271/246
6,325,559 B1 12/2001 Kaiser et al.
6,446,954 B1 * 9/2002 Lim et al. ..... 271/10.04
6,811,151 B2 * 11/2004 Wei-Feng et al. ..... 271/10.03
6,866,259 B2 3/2005 Underwood et al.
6,962,332 B2 * 11/2005 Su ..... 271/4.01
6,974,127 B2 * 12/2005 Kang ..... 271/10.11
7,451,975 B2 * 11/2008 Cook et al. ..... 271/117
7,540,485 B2 * 6/2009 Su et al. ..... 271/10.05
2003/0227130 A1 * 12/2003 Olson et al. ..... 271/242
2005/0206067 A1 * 9/2005 Cook et al. ..... 271/10.01
2006/0214357 A1 * 9/2006 Westhoff ..... 271/117
2008/0042339 A1 * 2/2008 Su et al. ..... 271/264

* cited by examiner

*Primary Examiner*—Patrick H Mackey
*Assistant Examiner*—Luis Gonzalez

(57) ABSTRACT

Various methods and apparatus are disclosed separating sheets of media.

23 Claims, 10 Drawing Sheets

SEPARATION SYSTEM

CROSS-REFERENCE TO RELATED PATENT APPLICATIONS

The present application is related to co-pending U.S. patent application Ser. No. 11/305,639 filed on Dec. 16, 2005 by Louis C. Barinaga and entitled TORQUE COUPLING, the full disclosure which is hereby incorporated by reference. The present application is further related to copending U.S. patent application Ser. No. 11/669,277 filed on the same day herewith by Raymond C Shermim, Allan G. Olson, Wesley R. Schalk and Juan D. Ramos and entitled MEDIA DRIVE, the full disclosure of which is hereby incorporated by reference.

BACKGROUND

Sheets of media picked from a stack may sometimes overlap, causing jams in a media handling system. However, extensive gaps between sequential sheets reduces throughput. Mechanisms for controlling gaps between sequential sheets are sometimes complex and expensive.

DETAILED DESCRIPTION OF THE EXAMPLE EMBODIMENTS

Figure 1:
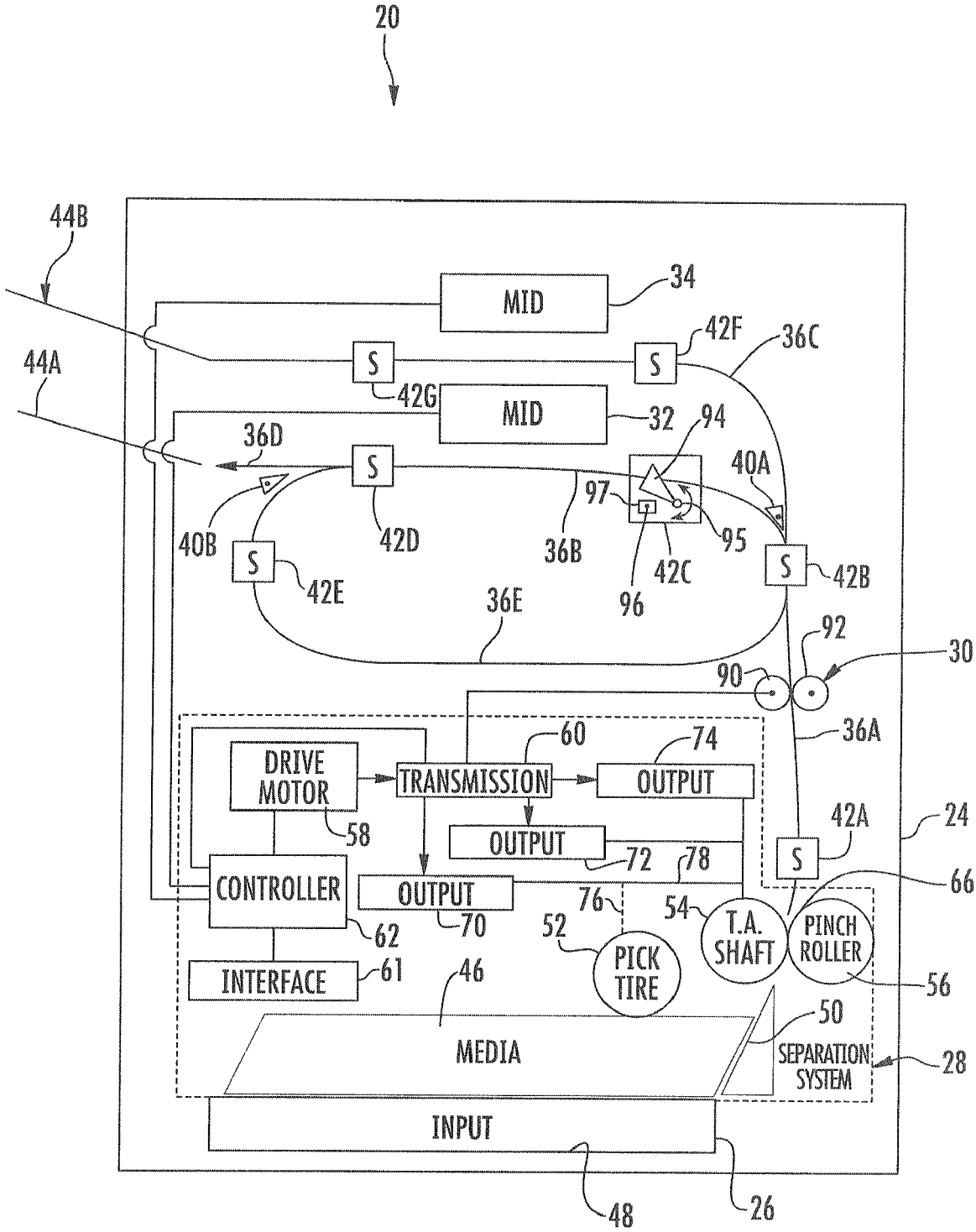
FIG. 1 is a schematic illustration of a media interaction system according to an example embodiment.

FIG. 1 schematically illustrates media interaction system 20 according to one example embodiment. Media interaction system 20 is configured to pick individual sheets of media from a stack and to interact with the sheets in one or more fashions. Such interactions include printing upon one or both sides of the sheets, scanning images upon such sheets, stapling such sheets, folding such sheets and the like. As will be described hereafter, media interaction system 20 reliably separates consecutive or sequential sheets while reducing cost and complexity of system 20.

As shown by FIG. 1, media interaction system 20 includes housing 24, media input 26, separation system 28, deskewing system 30, media interaction device 32, media interaction device 34, media paths 36A, 36B, 36C, 36D and 36E (collectively referred to as media paths 36), diverters and 40A and 40B (collectively referred to as diverters 40), sensors 42A, 42B, 42C, 42D, 42E, 42F and 42G (collectively referred to as sensors 42) and outputs 44A and 44B (collectively referred to as outputs 44). Housing 24 comprises an enclosure, framework or other arrangement of panels or structures configured to support and close components and devices of system 20. Housing 24 may have a variety of sizes, shapes and configurations. Although FIG. 1 schematically illustrates components in particular locations and relative positions within housing 24, in other embodiments, such components may be enclosed within housing 24 in other locations and relative positions.

Input 26 comprises one or more structures configured to support, hold and store sheets of media 46 prior to such sheets being picked and separated by separation system 28. Input 26 may comprise a tray, bin or other storage structures. Although input 26 is illustrated as being contained within housing 24, in other embodiments, input 26 may at least partially project beyond housing 24. In particular embodiments, input 26 may include a movable plate or floor 48 resiliently biased so as to urge a topmost sheet of media 46 in an upward direction for picking by separation system 28. In other embodiments, input 26 may alternatively have a fixed or stationary floor 48.

Media separation system 28 picks individual sheets of media 46 and separates consecutive picked sheets while moving such sheets towards media paths 36. Separation system 28 includes edge abutment surface 50, pick tire 52, take away shaft 54, pinch roller 56, drive motor 58, transmission 60, command interface 61 and controller 62. Edge abutment surface 50 comprises a surface configured to contact and abut leading edges of sheets of media 46 while such sheets are resting as part of a stack. In the particular embodiment illustrated, surface 50 extends in a plane that is oblique to an axis that is perpendicular to the face of the stack of media 46. In the particular example illustrated, the stack of media 46 rests in a horizontal orientation upon input 26. In another embodiment, the stack of media rests in a vertical or an upwardly sloped orientation. Because surface 50 is angled or oblique, surface 50 enhances separation of adjacent sheets in the stack of media 46. In other embodiments, surface 50 may alternatively extend perpendicular to the faces of the sheets of media 46 or may be omitted.

Pick tire 52 comprises one or more members configured to originally engage in contact a topmost sheet of the stack of media 46, wherein rotation of pick tire 52 moves the topmost sheet towards surface 50. In one embodiment, pick tire 52 comprises a cylindrical member having an outer circumferential surface having a relatively high coefficient of friction with media 46. In yet another embodiment, pick tire 52 may have a D-shaped cross-section. In other embodiments, pick tire 52 may be provided by a belt configured to contact the topmost sheet of media. In still other embodiments, pick tire 52 may have other configurations.

Take away shaft 54 comprises a shaft, roller or other member configured to be rotationally driven while in frictional contact with a sheet of media 46 so as to drive the sheet of media 46. Take away shaft 54 cooperates with rotatably supported pinch roller 56 to form a take-away nip 66 through which a sheet is driven into media path 36A. In other embodiments, other structures opposite to take away shaft 54 may be used in lieu of pinch roller 56 to form a take away nip 66 by which opposite faces of a sheet of media may be contacted and through which a sheet of media may be driven.

Drive motor 58 comprises a source of torque for rotationally driving at least pick tire 52 and take away shaft 54. In one embodiment, drive motor 58 comprises a motor dedicated to supplying torque in a single direction. In other embodiments, a motor 58 may be configured to selectively supply torque in both directions. According to one embodiment, motor 58 comprises a DC motor. In other embodiments, motor 58 may comprise other torque sources.

Transmission 60 comprises an arrangement of motion transmitting elements, such as gears, belts and pulleys, chain and sprockets or the like configured to transmit torque from motor 58 to both pick tire 52 and take away shaft 54. As schematically represented in FIG. 1, transmission 60 is selectively actuatable between three output states 70, 72 and 74. In output state 70, transmission 60 is configured such that torque delivered to pick tire 52 rotationally drives pick tire 52 in a first direction (as indicated by broken line 76) while torque delivered to take away shaft 54 rotationally drives shaft 54 in a second opposite direction (as indicated by solid lines 78). As a result, in response to control signals from controller 62, motor 58 may supply torque in a first direction, causing pick tire 52 to be rotationally driven in a forward media advancing or feeding direction (counterclockwise as seen in FIG. 1) while take away shaft is driven in an opposite reverse feeding direction (clockwise as seen in FIG. 1). By controlling motor 58 to supply torque in the first direction, system 20 may pick a topmost sheet of media 46 and urge a topmost sheet against and along surface 50 and into abutment with nip 66, which serves as a squaring surface, squaring the sheet at nip 66. In other embodiments, a sheet may be further driven by shaft 54 into abutment with another surface, such as another roller, for squaring or deskewing the sheet.

Alternatively, in response to control signals from control 62, motor 58 may supply torque in a second opposite direction, causing take away shaft 54 to be rotationally driven in a forward media advancing direction (counterclockwise as seen in FIG. 1) while pick tire 52 is out of driving engagement with media 46.). For purposes of this disclosure, a pick tire is "out of driving engagement" with a sheet or a stack of media when the pick tire is either not rotated or is idling (rotating while not under power) while in contact with media 46 due to a friction clutch (not shown) and/or is lifted or otherwise moved out of engagement with media 46 while being rotationally driven in a reverse feeding direction (clockwise as seen in FIG. 1. In particular, according to one embodiment, the supply of torque from drive motor 58 in the second direction results in an arm supporting pick tire 52 to be pivoted so as to lift pick tire 52 out of engagement with media 46. One example of such an arrangement for utilizing torque to lift pick tire 52 out of engagement with media 46 is shown and described in co-pending U.S. patent application Ser. No. 11/669,277 filed on the same day herewith by Raymond C. Sherman, Allan 0. Olson, Wesley P. Schalk and Juan D. Ramos and entitled MEDIA DRIVE, a full disclosure of which is hereby incorporated by reference. In other embodiments, other mechanism may be used to disengage pick tire 52 from media 46 as a result of motor 58 supplying torque in the second direction.

In output state 72, transmission 60 is configured such that torque delivered to pick tire 52 rotationally drives pick tire 52 in a forward media advancing direction (counterclockwise as seen in FIG. 1) at a first surface speed (the speed at the outermost surface of pick tire 52) and such that torque delivered to take away shaft 54 rotationally drives take away shaft 54 in the forward media advancing direction (counterclockwise as seen in FIG. 1) at a second surface speed greater than the first surface speed. As a result, consecutive or sequential sheets of media 46 are picked and driven to media path 36A with a substantially controlled and reliable gap therebetween.

Because sheets of media 46 are continuously picked by pick tire 52 and are continuously taken away and driven to media paths 36, media throughput is enhanced. Media throughput is not delayed by reversal of motor 58 to change from picking a sheet to feeding a sheet. Because the tire 52 and take away shaft 54 are both driven using torque supplied by a single motor 58, separation system 28 and system 20 may be less complex, less expensive and more compact. Moreover, because transmission 60 may be shifted to an output state wherein the pick tire is out of driving engagement with a stack of media, separation system 28 is well suited for use in printers or other media handling systems, wherein the entire stack of media may not be picked and printed or otherwise manipulated. For example, the picking and transport of sheets from a stack may be stopped prior to exhaustion of the stack and without taking and transporting an extra sheet which is blank and not printed upon.

At the same time, because transmission 60 provide a controlled and reliable gap between consecutive sheets in output state 72, separation system 28 is able to support various features such as edge-to-edge printing, skew correction and the sheet diversion to alternative media paths while sheets of media 46 are continuously picked by pick tire 52 and driven by take away shaft 54 without interruption. By reliably and consistently controlling the gap between consecutive sheets, transmission 60 of system 28 further enables the use of less complex and less expensive sensors. For example, since the gap is reliably controlled and since the likelihood of consecutive sheets accidentally overlapping is reduced, the positioning of sheets may be adequately sensed using less complex and less expensive non-transmissive sensors. One example of a non-transmissive sensor is a mechanical flag used in combination with a sensing device such as an optical sensor.

According to one embodiment, the difference in the surface speeds of pick tire 52 and take away shaft 54 is such that a trailing edge of a first sheet and a leading edge of a second subsequent sheet are spaced apart from one another by a gap of at least about 30 mm at one location along media path 36A after moving past nip 66. At the same time, the separation distance or gap between the trailing edge and the leading edge of consecutive sheets is reliably controlled. Consequently, the controlled gap is sufficiently large for supporting various features such as edge-to-edge printing, skew correction and the sheet diversion to alternative media paths while maintaining media throughput.

In output state 74, transmission 60 is configured such that torque is delivered to take away shaft 54 to rotationally drive take away shaft 54 in a forward media feeding direction (counterclockwise as seen in FIG. 1) while the little or no torque is transmitted to pick tire 52 such that pick tire 52 does not drive sheets of media 46 towards take away shaft 54. According to one embodiment, transmission 60 operates in output state 74 when a last or final sheet of media 46 from the stack has been removed. Output state 74 permits the final sheet to be transported further along media paths 36 by take away shaft 54 without an additional unwanted blank sheet picked from the stack of media 46. In other embodiments, output state 74 as well output state 70 may be omitted.

Command interface 61 comprises an interface by which instructions or commands are input to controller 62 from a source external to system 20. In particular, interface 61 facilitates the entry of commands selecting which of output states 70, 72 or 74 that transmission 60 two which transmission 60 is to be actuated. In one embodiment, interface 51 may be configured to receive commands or instructions from a person using system 20. For example, command interface 51 may comprise a keypad, a touchscreen, a mouse, a keyboard, a switch, button, or other means at which a person may manually enter selections. In other embodiments, interface 61 may comprise a microphone and associated voice or speech recognition software. In still other embodiments come interface 61 may comprise an electrical or optical connection with an external electronic control device such as an external computer or processor. In other embodiments, interface 61 may be omitted.

Controller 62 comprises a processing unit configured to generate control signals directing operation of drive motor 58 and transmission 60. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 62 may be embodied as part of one or more application-specific integrated circuits (ASICs). Unless otherwise specifically noted, the controller is not limited to any specific combination of hardware circuitry and software, nor to any particular source for the instructions executed by the processing unit.

In the particular embodiment illustrated, controller 62 additionally generates control signals directing the operation of media interaction device 32, media interaction device 34 and one or more actuators (not shown) configured to selectively actuate diverters 40 between different positions or diversion states. In the embodiment illustrated, controller 62 further receives information or signals from various sensors of system 20 including, but not limited to, sensors 42. Controller 62 is configured to use and analyze such information received from sensors 42 to generate the aforementioned control signals. In other embodiments, separate controllers may be provided for one or more of such components of system 20.

In operation according to one embodiment, in response to receiving input the interface 61, controller 62 generates control signals actuating transmission 60 to output state 70 and generate control signals causing motor 58 to supply torque in the first direction. As a result, the top most sheet of media 46 is picked by pick tire 52 and squared against take away shaft 54, rotating in a reverse direction. Thereafter, controller 62 will generate control signals causing drive motor 58 to supply torque in the second direction. This results in take away shaft 54 further driving be picked sheet of media 46 into media path 36A and results in the pick tire 52 being withdrawn from media 46. Because pick tire 52 is withdrawn from the stack of media 46, skewing of the picked sheet being transported by shaft 54 may be less likely.

In response to receiving input via interface 61 requesting faster throughput of system 20, controller 62 generates control signals actuating transmission 60 to output state 72. As a result, both pick tire 52 and take away shaft 54 are concurrently driven by motor 58 and the media advanced direction, with take away shaft 54 being driven at a slightly faster surface speed as compared to pick tire 52. This results in a controlled gap between successive sheets of media 46. In response to the last or final sheet being picked from the stack media 46, controller 62 generates control signals actuating transmission 60 to output state 74 or output state 70 with motor 58 being driven in the second direction. As a result, the last or final sheet is transported by take away shaft 54 and no additional sheets are picked by pick tire 52.

Deskewing system 30 comprises an arrangement of components configured to square off sheets of media 46 after such sheets have exited nip 66. In the example embodiment shown, the skewing system 30 is configured to drive a sheet that is passed nip 66 in a reverse direction against a squaring surface. In the example illustrated, a squaring surface is provided by nip 66. In other embodiments, other surfaces generally perpendicular to media path 36A may serve as a squaring surface.

In the particular about illustrated, deskewing system 30 includes feed shaft 90 and pinch roller 92. Feed shaft 90 comprises one or more rollers configured to frictionally engage a sheet of media along media path 36A and to be selectively rotationally driven in one or both directions. Feed shaft 90 cooperates with idler 92 to sandwich a sheet of media therebetween. In one embodiment, idler 92 comprises an idling roller configured to frictionally engage an opposite side of a sheet of media. In other embodiments, other surfaces opposite to the roller 90 which are rotationally driven or which are stationary may be employed. Feed shaft 90 is configured to be rotationally driven in a reverse direction to drive a sheet of media against nip 66 so as to square the sheet of media against a nip 66. In other embodiments, shaft 54 may alternatively drive a leading edge of a sheet into abutment with roller 90 while roller 90 is being rotated in a reverse direction to square the media sheet. Because separation system 28 provides a controlled and reliable gap between successive sheets with a reduced likelihood of such sheets overlapping, system 30 has time to reverse the direction of movement of a first sheet to square the first sheet against nip 66 prior to arrival of a successive sheet. As a result, squaring may be performed with a reduced risk of sheets becoming overlapped and with a reduced risk of jams or other media handling issues.

In one embodiment, feed shaft 90 is additionally configured to be rotationally driven in a forward media advancing direction to move sheets of media towards either of media feed paths 36B or 36C. As schematically illustrated in FIG. 1, feed shaft 90 is configured to be rotationally driven using output from transmission 60 which receives torque from motor 58. In other embodiments, feed shaft 90 may be rotationally driven by other sources of torque or other transmissions. In still other embodiments, deskew system 30 may be omitted.

Media interaction device 32 comprises and mechanism configured to interact with a sheet of media. In one embodiment, media interaction device 32 is configured to scan or capture an image contained on one or both faces of a sheet of media. In another embodiment, media interaction device 32 is configured to modify a sheet of media. For example, media interaction device 32 may be configured to staple, fold or print upon a sheet of media. In the particular embodiment illustrated, media interaction device 32 comprises a device configured to print along an adjacent to one or both of a trailing edge and a leading edge of the sheet of media. For example, in one embodiment, media interaction device 32 comprises one or more drop-on-demand ink jet print heads which deposit eight or other fluid upon a sheet of media. To print adjacent to either the leading edge of the trailing edge of the sheet of media, media interaction device 32 over sprays the fluid from its nozzles. Because separation system 28 provides a controlled separation distance or gap between consecutive sheets while reducing the likelihood of overlap of such sheets, media interaction device 32 may better print or deposit fluid, such as ink, adjacent to the forward or leading edges with a reduced risk of such fluid being deposited on a successive sheet. At the same time, separation system 28 permits this controlled gap to be maintained while through putting media at a relatively fast rate.

Media interaction device 34 comprises a mechanism configured to interact with a sheet of media. In one embodiment, media interaction device 32 is configured to scan or capture an image contained on one or both faces of a sheet of media. In another embodiment, media interaction device 32 is configured to modify a sheet of media. In one embodiment, media interaction device 34 is different from media interaction device 32, permitting system 20 to provide multiple media treatment functions.

Media paths 36 comprise channels, passages or cavities through which sheets of media are guided and driven from nip 66 and ultimately to one of outputs 44. Media paths 36 are formed by media guiding panels, tabs, or other stationary structures as well as rotationally driven or idling rollers, belts or wheels. In the particular example illustrated, media path 36A leads from nip 66 to diverter 40A. Media path 36B extends from media path 36A across or through media interaction device 32 to diverter 40B. Media path 36 extends from diverter 40A, across or through media interaction device 34 and to output 44B. Media path 36D extends from diverter 40B to output 44A. Media path 36E extends from diverter 40B back to media path 36A. Media path 36E permits sheets to be overturned for printing on an opposite face of a sheet of media or for scanning an opposite face of a sheet of media, depending upon the function performed by media interaction device 32.

Diverters 40 comprise structures, such as flaps, configured to move between different positions or states with respect to adjacent media paths 36 so as to selectively channel or direct sheets of media between two or more alternative paths 36. Diverters 40 are actuated between such different positions by one or more actuators, such as electric solenoids (not shown), which are actuated in response to control signals from controller 62. In the particular example illustrated, diverter 40A selectively directs sheets of media to either media path 36B for interaction by media interaction device 32 or media path 36C for interaction by media interaction device 34. Diverter 40B selectively directs sheets of media to either media path 36D and output 44A or media path 36E for overturning of the sheet and for potential subsequent interaction with either media interaction device 32 or media interaction device 34.

Although system 20 is illustrated as including the aforementioned media paths 36 and aforementioned diverters 40, in other embodiments, system 20 may include a greater or fewer of such paths were diverters. Because separation system 28 provides a controlled gap between sequential sheets of media 46, diverters 40 have a greater amount of time to be actuated between different diversion positions. As a result, diverters 40 may more reliably direct sheets of media to a selected media path 36.

Sensors 42 comprise of devices configured to sense or otherwise detect the presence of a sheet of media 46 at a particular point along one of media paths 36. Sensors 42 provides signals to controller 62 indicating to controller 62 the location of a sheet of media at a particular point in time, permitting controller 62 to generate control signals appropriately directing the operation of media interaction devices 32 and 34 as well as movement of diverters 40. Although system 20 is illustrated as including the depicted sensors 42A-42E at the noted locations, in other embodiments, system 20 may include a greater or fewer of such sensors 42 and such sensors 42 may be positioned at other locations.

Because separation system 28 provides a controlled gap between consecutive sheets of media 46 with a reduced likelihood of inadvertent overlap of such sheets while providing high media throughput, system 20 may employ less complex and less expensive non-transmissive sensors. Non-transmissive sensors are sensors that do not have the additional complexity associated with sensing overlapping sheets or sensing through sheets.

One example of a non-transmissive a sensor is a non-transmissive mechanical sensor as depicted in more detail with a sensor 42C. As shown by FIG. 1, sensor 42C includes a structure, such as a flag 94 pivotally supported about a pivot axis 95 between a first position in which flag 94 extends across or intercepts an adjacent media path 36 (such as when no sheet is present) and a second position in which flag 94 blocks or intercepts light from a light emitter 96 before the light reaches a light detector 97. In such an embodiment, flag 94 is resiliently biased to a position across the media path 36 such that upon encountering a sheet of media, flag 94 is moved to the second position.

By providing a sufficiently sized and controlled gap between consecutive sheets, separation system 28 provides the flags 94 of sensors 42 with a sufficient amount of time to return to their initial media path intercepting position after a trailing edge of a first sheet has passed and before encountering a leading edge of a second consecutive sheet. In one embodiment, the gap between consecutive sheets is sized such a sensor 42 has at least 20 ms to resiliently return to its media path intercepting position after the first sheet has passed sensor 42. In other embodiments, other mechanical non-transmissive sensors may be employed.

Outputs 44A and 44B comprise trays, bins or other structures configured to receive and store interact upon sheets of media. Although system 20 is illustrated as including two separate outputs 44, and other embodiments, system 20 may have a greater or fewer of such outputs 44.

FIGS. 2-10 illustrate media interaction system 120, another embodiment of system 20. In the particular embodiment illustrated, media interaction system 120 comprises a printer configured to deposit printing material upon sheets of media. In other embodiments, system 120 may comprise other devices that interact with sheets of media. Like system 20, media interaction system 120 reliably separates consecutive or sequential sheets while reducing cost and complexity and with reduced likelihood of picking an extra sheet from a stack.

As shown by FIGS. 2-5, media interaction system 120 includes housing 124, media input 126, separation system 128, media interaction device 132, media path 136 and output 44A (shown and described with respect to system 20). Housing 124 comprises an enclosure, frame or other arrangement of panels or structures configured to support and enclose components and devices of system 120. Housing 124 may have a variety of sizes, shapes and configurations.

Figure 2:
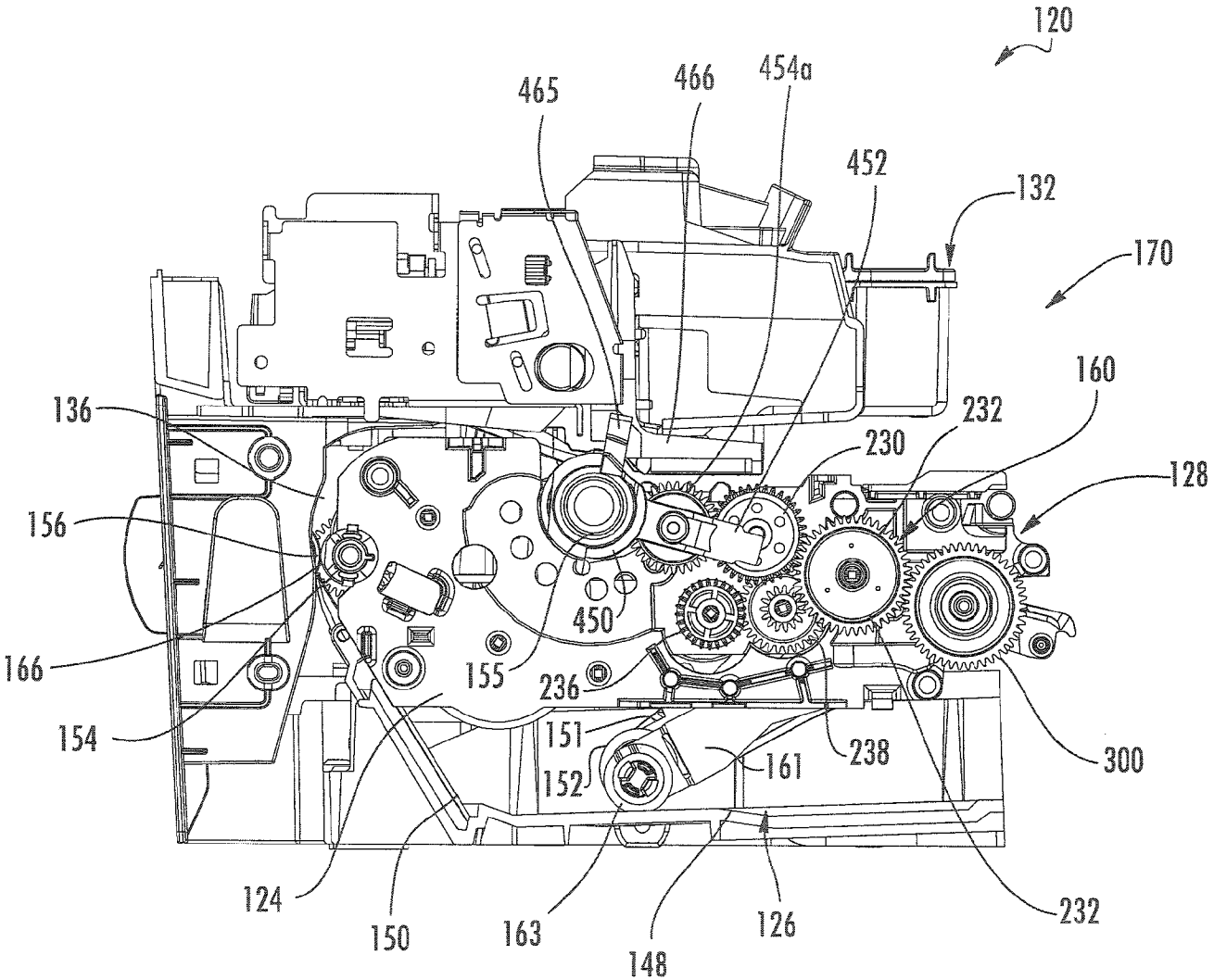
FIG. 2 is a side elevational of another embodiment of the media interaction system of FIG. 1 according to an example embodiment.

Input 126 comprises one or more structures configured to support, hold and store sheets of media in a stack prior to such sheets being picked and separated by separation system 128. In the particular embodiment illustrated coming input 126 comprises a tray. In other embodiments, input 126 may be integrally provided as part of the housing 124 or may comprise other stack storage structures such as a bin. Although input 126 is illustrated as having a fixed or stationary floor 148, in other embodiments, input 126 may include a movable plate or floor resiliently biased so as to urge a top most sheet of media in an upward direction as seen in FIG. 2 for picking by separation system 128.

Separation system 128 picks individual sheets of media from a stack of media contained within input 126 and separates consecutive picked sheets while moving such sheets towards media path 136. Separation system 128 includes edge abutment surface 150, arm 151, pick tire 152, take away shaft 154, feed shaft 155, roller 156, drive motor 158 (shown in FIG. 3), transmission 160, command interface 61 (schematically illustrated in FIG. 3 and described with respect to FIG. 1) and controller 62 (schematically shown in FIG. 3 and described with respect to FIG. 1). Edge abutment surface 150 comprises a surface configured to contact and abut leading edges of sheets of media while such sheets are resting as part of a stack. As shown in FIG. 2, surface 150 extends in a plane that is oblique to an axis that is perpendicular to floor 148. Because surface 150 is oblique, surface 150 facilitates the separation of adjacent sheets in a stack. In other embodiments, surface 150 may alternatively extend perpendicular to the faces of the sheets or may be omitted.

Figure 3:
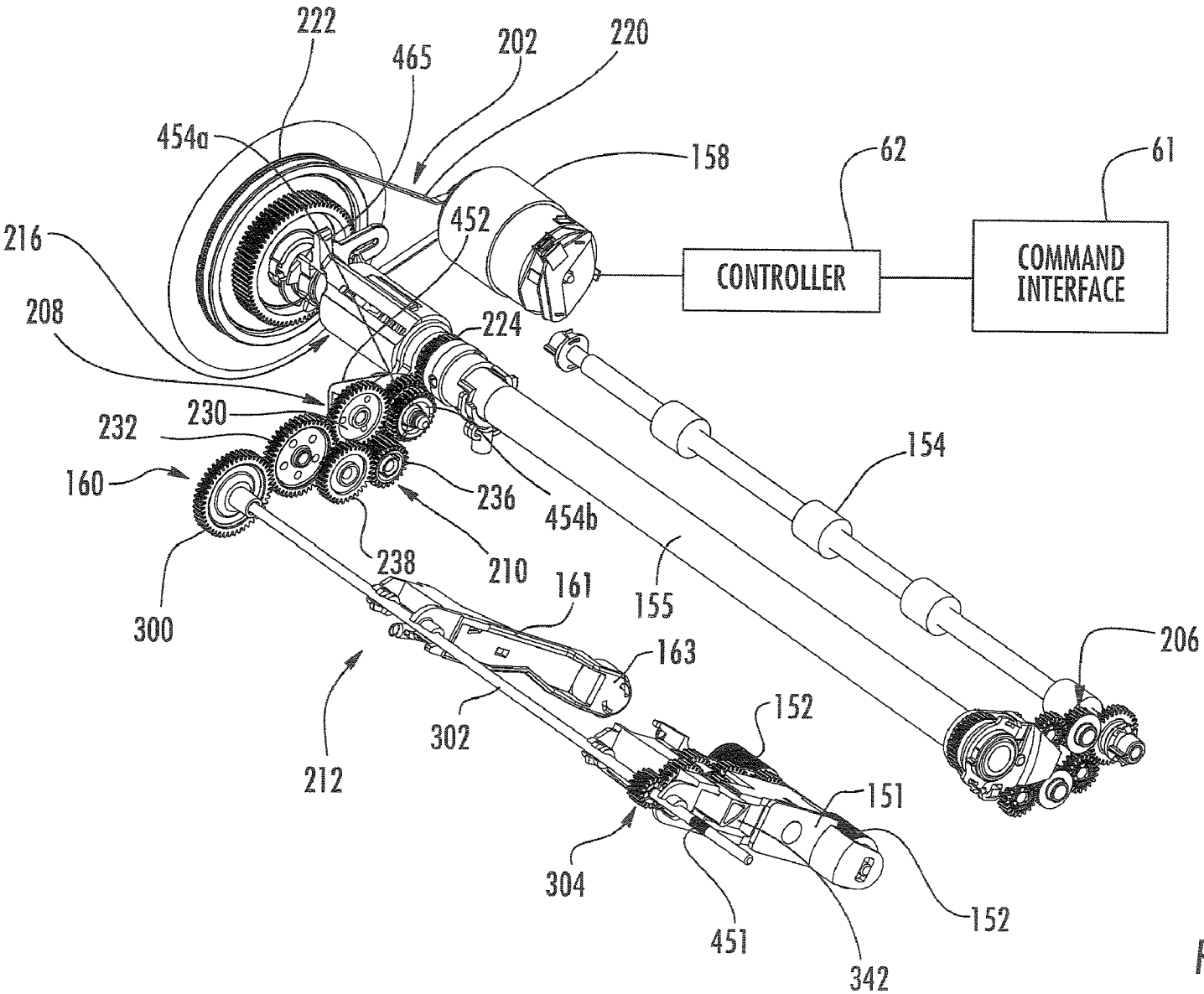
FIG. 3 is a top perspective view of a portion of the media interaction system of FIG. 2 illustrating a transmission in a first output state according to an example embodiment.
Figure 5:
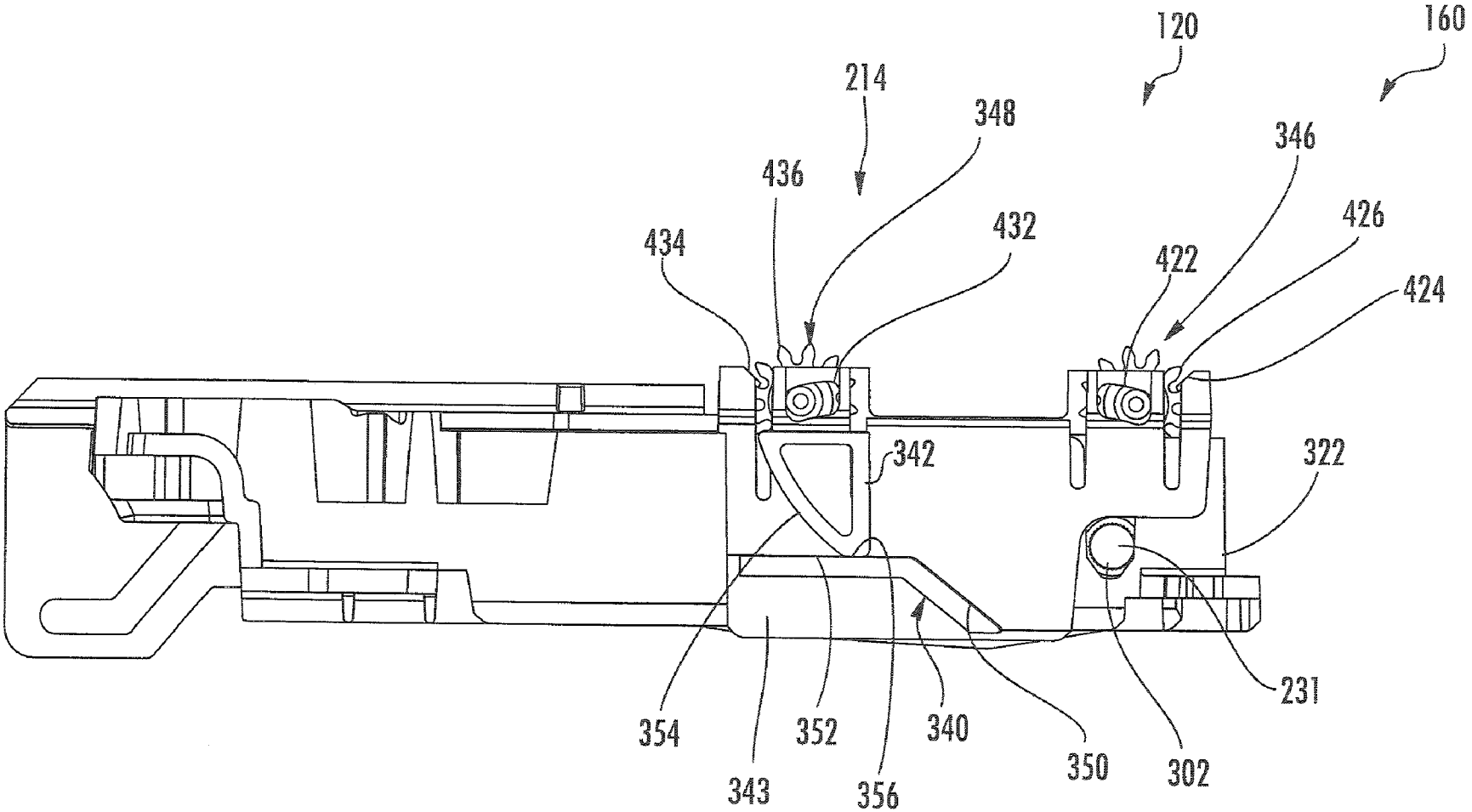
FIG. 5 is a side elevational view of the media lift mechanism of FIG. 4 and a second pick tire state according to an example embodiment.

Arm 151 comprises an elongated member rotationally supporting pick tire 152 and pivotally supported so as to pivot between a lower media engaging position (shown in FIG. 2) and a raised or elevated media disengaged position (shown in FIG. 5). In other embodiments, arm 151 may have a variety of sizes, shapes and configurations. In addition, in other embodiments, system 120 may include multiple arms having multiple pick tires. As shown in FIGS. 2 and 3, system 120 includes a bias arm 161 carrying an idling roller 163 which bear against a stack of media in input 126. In other embodiments, bias arm 161 and roller 163 may be omitted or additional such bias arms may be employed.

Pick tire 152 comprises one or more members configured to rotationally engage and contact a top most sheet of a stack of media, wherein rotation of the tire 152 moves the top most sheet towards surface 150. In the embodiment illustrated, pick tire comprises a cylindrical member having an outer circumferential surface having a relatively high coefficient of friction with the media. In another embodiment, pick tire 152 may have a D-shaped cross-section. In yet other embodiments, pick tire 152 may be provided by a belt configured to contact the top most sheet of a stack. In still other embodiments, pick tire 152 may have other configurations.

Take away shaft 154 comprises a shaft, roller or other member configured to be rotationally driven while in frictional contact with a sheet of media so as to drive the sheet of media. Take away shaft 154 cooperates with a rotationally supported idler roller 156 to form a take away nip 166 through which the sheet is driven into media path 136. In other embodiments, other structures opposite to take away shaft 154 may be used in lieu of roller 156 to form a take away nip 166.

Feed shaft 155 (shown in FIG. 3) extends across media path 136 and is configured to further engage and move sheets of media along media path 136. Feed shaft 155 is generally located downstream from take away shaft 154 along media path 136. In one embodiment, feed shaft 155 is also configured to be rotated in the reverse direction while take away shaft 154 is driven in a forward direction, wherein shaft 155 provides a squaring surface for deskewing sheets of media. In the example embodiment illustrated, feed shaft 155 also serves as part of the transmission 160.

Drive motor 158 comprises a source of torque for rotationally driving at least pick tire 152 and take away shaft 154. In the embodiment illustrated, drive motor 158 comprises a motor configured to supply torque in both directions. In another embodiment, drive motor 158 comprises a motor configured to supply torque in both directions. According to one embodiment, motor 158 comprises a DC motor. In other embodiments, motor 158 may comprise other torque sources.

Transmission 160 comprises an arrangement of motion transmitting elements, such as gears, belts and pulleys, chains and sprockets or the like configured to transmit torque from motor 158 to pick tire 152 and to take away shaft 154. As will be described hereafter, transmission 160 is selectively actuatable between three output states: output state 170 (shown in FIGS. 2-5, output state 172 (shown in FIG. 9 and output state 174 (shown in FIGS. 6, 7 and 10). In output state 170, transmission 160 transmits torque such that pick tire 152 and feed shaft 155 are driven in opposite directions. As a result, motor 158 is reversed to alternate between picking of a sheet and driving a picked sheet to create a gap between consecutive sheets. In output state 172, both the pick tire 152 and take away shaft 154 are driven in a same direction by the different surface speeds so as to create gap. In output state 174, transmission 160 stops transmitting torque to pick tire 152 while continuing to transmit torque to take away shaft 154. Output state 174 permits the last desired sheet to be transported by take away shaft 154 and feed shaft 155 through and along media path 136 while pick tire 152 is out of driving engagement such that an extra sheet is not picked at the end of a job.

In the particular example embodiment illustrated, transmission 160 includes power train 202, feed shaft 155, power train 206, power train 208, power train 210, power train 212, media lift mechanism 214 (shown in FIGS. 4 and 5) and shifter 216. Power train 202 comprises an arrangement of motion transmitting members configured to transmit torque from motor 158 to feed shaft 155. In the example illustrated, power train 202 includes belt 220 and pulley 222 which is fixed to feed shaft 155. In other embodiments, power train 202 may comprise a gear train, a chain and sprocket arrangement or combinations thereof.

Feed shaft 155 extends from pulley 222 and extends across media path 136 (shown in FIG. 2) to power train 206. Feed shaft 155 includes gear 224 which is configured to be selectively operably coupled to either power train 208 or power train 210 by shifter 216. Feed shaft 155 transmits torque to power train 206 and selectively to power train 212 depending upon a state of the shifter 216.

Power train 206 comprises an arrangement of motion transmitting members operably coupled to one another between feed shaft 155 and take away shaft 154. As shown by FIG. 3, power train 206 comprises a gear train operably connected between feed shaft 155 and take away shaft 154. Power train 206 maintains a forward rotation of shaft 154 independent of the rotation direction of shaft 155. In other embodiments, power train 206 may alternatively include a belt and pulley arrangement, a chain and sprocket arrangement or combinations of one or more of a gear train, a belt and pulley arrangement or a chain and sprocket arrangement.

Power train 208 comprises an arrangement of motion transmitting members operably located between shifter 216 and power train 212. As shown by FIGS. 2 and 3, power train 208 includes gears 230 and 232. Gear 230 configured to be selectively engage by shifter 216. Gear 232 a mesh engagement with gear 230 and is connected to power train 212. Power train 208 configured such that when torque is transmitted to power train 212 by power train 208 in a first direction (rotation of pulley 222 in a clockwise direction as seen in FIG. 3), pick tire 152 is driven in a forward media advancing direction while take away shaft 154 is also driven in a forward direction and while feed roller 204 is driven in a reverse direction. Power train 208 is configured such that when torque is transmitted to power train 212 by power train 208 in a second opposite direction (rotation of pulley 222 in a counterclockwise direction as seen in FIG. 3), pick tire idles while in contact with a sheet as a result of the one way clutch 454 and take away shaft 154 and feed shaft 155 are both driven in a forward media advancing direction.

Power train 210 comprises a series of motion transmitting members operably coupled between shifter 216 and power train 212. In contrast to power train 208, power train 210 is configured such that when torque is transmitted to power train 212 by power train 210 in the first direction, media lift mechanism 214 lifts pick tire 152 out of engagement with a stack of media while take away shaft 154 is driven in a forward direction and feed shaft 155 is driven in a reverse direction. Powertrain 210 is configured such that when torque is transmitted to powertrain 212 by powertrain 210 in the second direction, pick tire 152 is driven in the same direction as the direction in which take away shaft 154 and feed shaft 155 are driven. In addition, pick tire 152 is rotationally driven at a surface speed less than the surface speed at which take way shaft 154 is driven. As a result, although sheets are continuously picked and transported for enhanced efficiency, separation system 128 provides a controlled gap between consecutive sheets. By reliably and consistently controlling the gap between consecutive sheets, transmission 160 of system 128 further enables the use of less complex and less expensive sensors. For example, since the gap is reliably controlled and since the likelihood of consecutive sheets accidentally overlapping is reduced, the positioning of sheets may be adequately sensed using less complex and less expensive non-transmissive sensors. One example of a non-transmissive sensor is a mechanical flag using combination with a sensing device such as an optical sensor.

According to one embodiment, the difference in the surface speeds of pick tire 152 and take away shaft 154 is such that a trailing edge of a first sheet and a leading edge of a second subsequent sheet are spaced apart from one another by a gap of at least about 30 mm at one location along media path 136 after moving past nip 166. Consequently, the controlled gap is sufficiently large for supporting various features such as edge-to-edge printing, skew correction and the sheet diversion to alternative media paths while maintaining media throughput.

In the example illustrated, power train 210 includes gears 236, gear 238 and a gear 232. Gear 236 is configured to be operably engaged by shifter 216 and is in meshing engagement with gear 238. Gear 238 comprises a cluster gear in meshing engagement with gear 236 and also in meshing engagement with gear 232. As noted above, gear 232 is connected to power train 212. Although power train 208 and 210 are illustrated as comprising gear trains, in other embodiments, such power trains may additionally or alternatively include belt and pulley arrangements or chain and sprocket arrangements. Such power trains may include a greater or fewer of the noted gears.

Power train 212 comprises an arrangement of motion transmitting members operably coupled between gear 232 and pick tire 152. Power train 212 is further operably connected to lift mechanism 214 (shown in FIGS. 4 and 5). As shown by FIG. 3, power train 212 includes gear 300, shaft 302 and gear train 304. Gear 300 is fixedly secured to shaft 302. Shaft 302 is connected to gear train 304. As noted above, shaft 302 further pivotally supports arm 151 and is pivotally supported by a portion of lift mechanism 214 at one end. Gear train 304 comprises a series of gears extending from shaft 302 to pick tire 152. Torque transmitted via gear train 304, drives pick tire 152.

Figure 4:
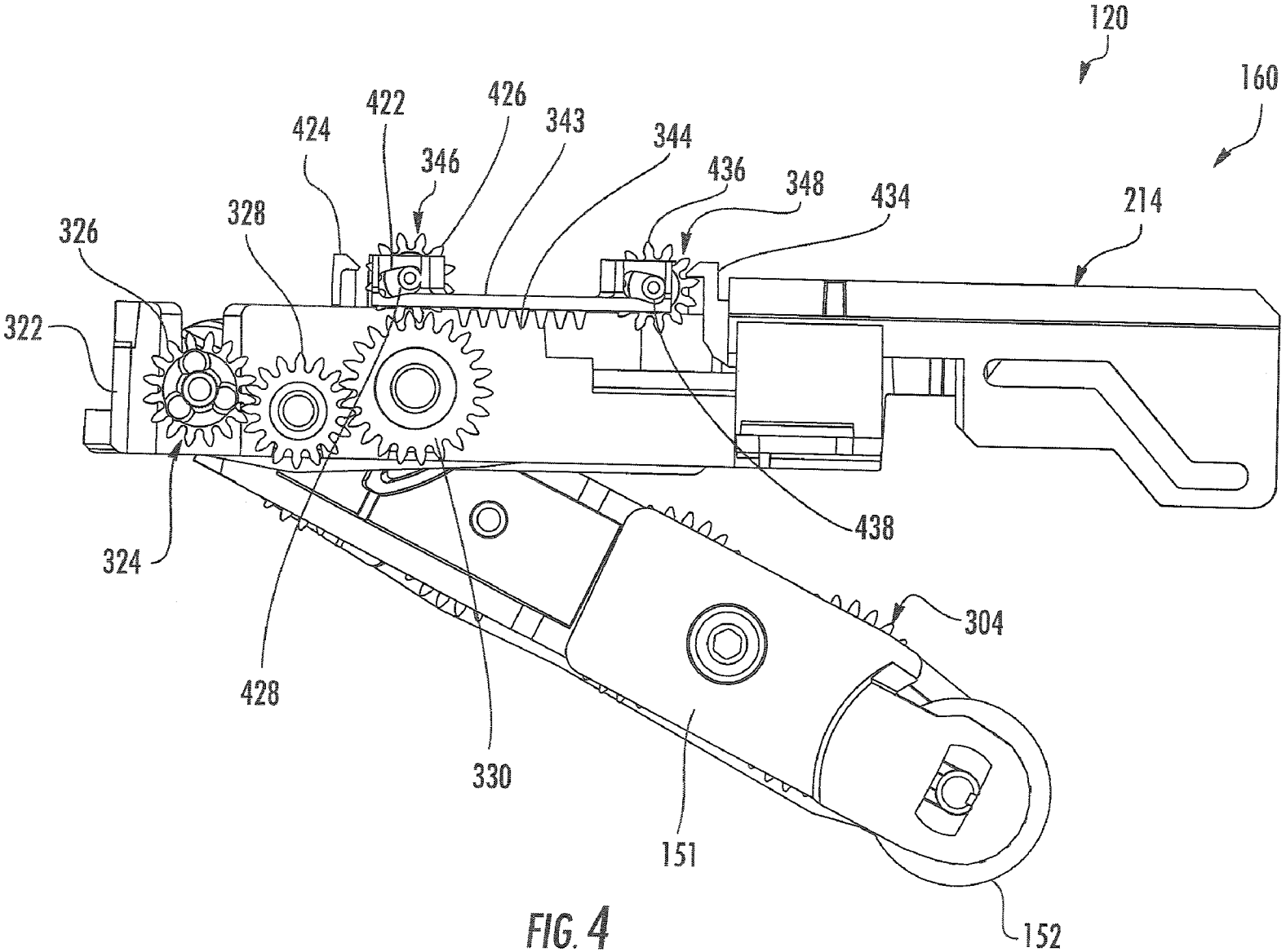
FIG. 4 is a sectional elevational view of a media lift mechanism of the transmission of FIG. 3 in a first pick tire state according to an example embodiment.

FIGS. 4 and 5 illustrate lift mechanism 214. Lift mechanism 214 is shown and described in co-pending U.S. patent application Ser. No. 11/669,277 filed on the same day herewith by Raymond C. Sherman, Allan G. Olson, Wesley R. Schalk and Juan D. Ramos and entitled MEDIA DRIVE, the full disclosure of which is hereby incorporated by reference. Lift mechanism 214 comprises a mechanism configured to selectively move pick tire 152 toward or away from floor 148 of input 126 (shown in FIG. 2). In the example illustrated, lift mechanism 214 is configured to selectively pivot arm 151 so as to move pick tire 152 relative to a stack of media in input 126. As shown by FIGS. 4 and 5, lift mechanism 214 includes support 322, drive train 324 including gears 326, 328 and 330, cam 340, cam follower 342, rack 343, rack gear 344 and disengagement mechanisms 346, 348.

Support 322 comprises one or more structures configured to slidably support portions of lift mechanism 214. In one embodiment, support 322 comprises a bar which is stationarily supported by housing 124 (shown in FIG. 2). In other embodiments, support 322 may have other configurations. For example, in other embodiments, separate structures or different configurations may be utilized to slidably support portions of lift mechanism 214.

Drive train 324 transmits power from shaft 302 of power train 212 to selectively raise or lower arm 151 and pick tire 152. Gear 326 is fixed to an end of shaft 302 (at the knurled location 349 shown in FIG. 3). Gear 326 is in meshing engagement with gear 328. Gear 328 is an idler gear rotationally supported by support 322 in meshing engagement with gear 330. Gear 330 is configured to be selectively engaged with rack gear 344 or one of disengagement mechanisms 346, 348. Gear 330 cooperates with rack gear 343 to move cam 340 relative to cam follower 342.

Cam 340 comprises a collection of surfaces configured to be linearly moved or translated against cam follower 342 which result in control the movement of cam follower 342 and arm 151. As shown in FIG. 5, cam 340 extends from rack 343 and includes a ramp surface 350 and a plateau 352. Ramp surface 350 is an inclined or sloped surface against which cam follower 342 slides up surface 350 when rack 343 is being linearly moved to the right (as seen in FIG. 5) so as to pivot arm 151 in a clockwise direction (as seen in FIG. 5) about axis 231 away from floor 148 (shown in FIG. 2). When rack 343 is being moved to the left, cam follower 342 slides down surface 350 to pivot arm 151 in a counter-clockwise direction (as seen in FIG. 3) about axis 231 towards floor 148 (shown in FIG. 2).

Plateau 352 is a substantially flat or planar surface extending substantially parallel to the direction in which rack 343 linearly translates. Plateau 352 provides a surface against which cam follower 342 rests when arm 151 is in a fully raised position. As a result, when cam follower 342 is against plateau 352, further movement of cam 340 does not result in further pivoting of arm 151. As a result, plateau 352 provides a set or predetermined pivotal stop or point for arm 151 which is less sensitive to imprecise positioning of cam 340. In other embodiments, cam 340 may have other configurations.

Cam follower 342 comprises a structure coupled to arm 151 so as to move with arm 151 and so as to engage and follow cam 340. FIG. 5 illustrates cam follower 342 extending from arm 151. As shown in FIG. 5, cam follower 342 includes an arcuate surface 354 and a toe 356. Surface 354 is arcuate so as to facilitate sliding and pivoting of arm 151 as cam 340 is moved against cam follower 342. Toe 356 is a substantially flat end or tip configured to more stably rest upon plateau 352 when arm 151 has been pivoted to the fully raised position or media disengaging state. In other embodiments, cam follower 342 may have other configurations.

Rack 343 comprises a structure configured to linearly slide along support 322 while carrying cam 340, rack gear 344 and disengagement mechanisms 346 and 348. In other embodiments, rack 343 may have other configurations and may be slidably supported for linear movement by other structures.

As shown by FIG. 4, rack gear 344 extends from rack 343 across from or opposite to gear 330. Rack gear 344 cooperates with gear 330 to linearly move rack gear 344 in response to rotation of gear 330 when gear 330 is in meshing engagement with rack gear 344. Rack gear 344 has a sufficient length to translate cam 340 a sufficient distance so as to pivot arm 151 and pick tire 152 between the fully lowered and the fully raised positions.

Figure 7:
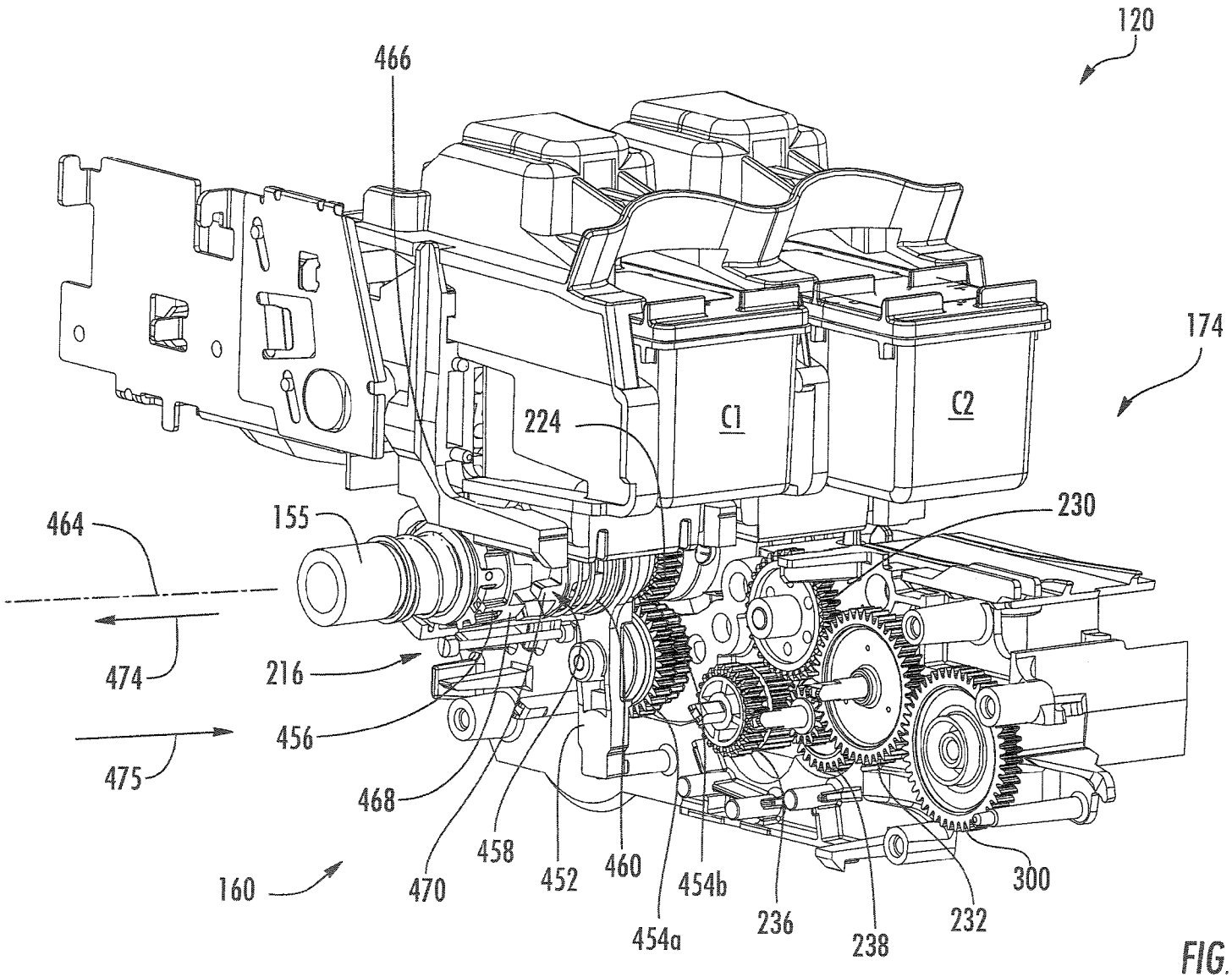
FIG. 7 is a perspective view of the media interaction system of FIG. 7 illustrating the shifter with portions omitted for purposes of illustration according to an example embodiment.

Disengagement mechanisms 346 and 348 are located at opposite ends of rack gear 344 and comprise mechanisms configured to selectively disengage gear 330 from rack gear 344 depending upon the direction in which gear 330 is being rotationally driven. Disengagement mechanisms 346 is configured to disengage gear 330 when gear 330 is engaging disengagement mechanisms 346 and is rotating in a clockwise direction as seen in FIG. 7. Disengagement mechanisms 346 is further configured to engage gear 330 with rack gear 344 in response to gear 330 rotating in a second direction while in engagement with disengagement mechanisms 346. Because disengagement mechanisms 346 disengages gear 330 from rack gear 344 when gear 330 is rotating in a first direction and when gear 330 is in engagement with disengagement mechanisms 346 at one end of rack gear 344, shaft 302 and gear 330 may continue to rotate so as to continue to transmit torque to pick tire 152 without further movement of rack 343 and cam 340. In other words, media drive member 226 may continue to drive a sheet of media in the media driving state while arm 151 is stationary.

In the example embodiment illustrated, disengagement mechanisms 346 includes slot 422, catch 424 and lost motion element 426. Slot 422 comprises an elongate channel configured to guide sliding translation as well as rotation of lost motion element 426. Slot 422 is coupled to and carried by rack 343 and is configured to facilitate movement of lost motion element 426 between a first position (shown in FIG. 4) in which the lost motion element 426 freely rotates within slot 422 at one end of slot 422 and a second position in which lost motion element 426 engages catch 424 such that rotation of element 426 is inhibited. In other embodiments, slot 422 may comprise other guiding mechanisms or structures.

Catch 424 comprises one or more structures couple to and carried by rack 343 and configured to engage lost motion element 426 so as to inhibit or stop rotation of lost motion element 426. In the embodiment illustrated, catch 424 comprises a hook-like structure configured to engage teeth of lost motion element 426. In other embodiments, catch 424 may comprise other structures or may alternatively or additionally be formed from a material having a high coefficient of friction with lost motion element 426 so as to inhibit relative rotation of lost motion element 426.

Lost motion element 426 comprises a structure configured to be rotated when in engagement with gear 330, to slide within slot 422 between a substantially freely rotating position and a caught or locked position, and to catch or engage catch 424. In the example embodiment, lost motion element 426 comprises a gear having an axle 428 slidably and rotationally received within slot 422. In other embodiments, lost motion element 426 may comprise other lost motion elements. For purposes of this disclosure, the term "lost motion element" is any structure or combination of structures configured to be moved, rotationally or linearly, without transferring motion to an adjacent structure and with insubstantial drag or frictional resistance.

Disengagement mechanism 348 is substantially similar to disengagement mechanisms 346 but is alternatively configured to disengage gear 330 from rack gear 344 in response to gear 330 in engagement with disengagement mechanism 348 and when gear 330 rotating in a counter-clockwise direction as seen in FIG. 7. Disengagement mechanism 348 is further configured to engage gear 330 with rack gear 344 in response to gear 330 rotating in a clockwise direction with as seen in FIG. 7 and while in engagement with disengagement mechanism 348. As a result, motor 158 may continue to drive gear 330 without further movement of rack 343 and cam 340 or further movement of arm 151 when media drive member 226 has been sufficiently moved to the disengaged state and when rack 343 has reached its travel limit.

In the particular example illustrated, disengagement mechanism 348 is similar to disengagement mechanisms 346. Disengagement mechanism 348 includes slot 432, catch 434 and lost motion element 436. Slot 432, catch 434 and lost motion element are each substantially identical to slot 422, catch 424 and lost motion element 426, respectively, except that catch 424 is on an opposite side of slot 422 and faces in an opposite direction as compared to catch 424. Like disengagement mechanisms 346, disengagement mechanism 348 permits continued rotation of gear 330 without imposition of substantial drag upon the rotation of gear 330 and without substantial noise.

Although disengagement mechanisms 346 and 348 are illustrated as being substantially identical to one another, in other embodiments, disengagement mechanisms 346 and 348 may alternatively be different from one another. In other embodiments, one or both of disengagement mechanisms 346, 348 may have other configurations. For example, in other embodiments, one or both of disengagement mechanisms 346 and 348 may comprise a one-way clutch. Examples of one-way clutches include, but are not limited to, a ratchet-type one-way clutch, a frictional one-way clutch or a check-ball one-way clutch.

Figure 6:
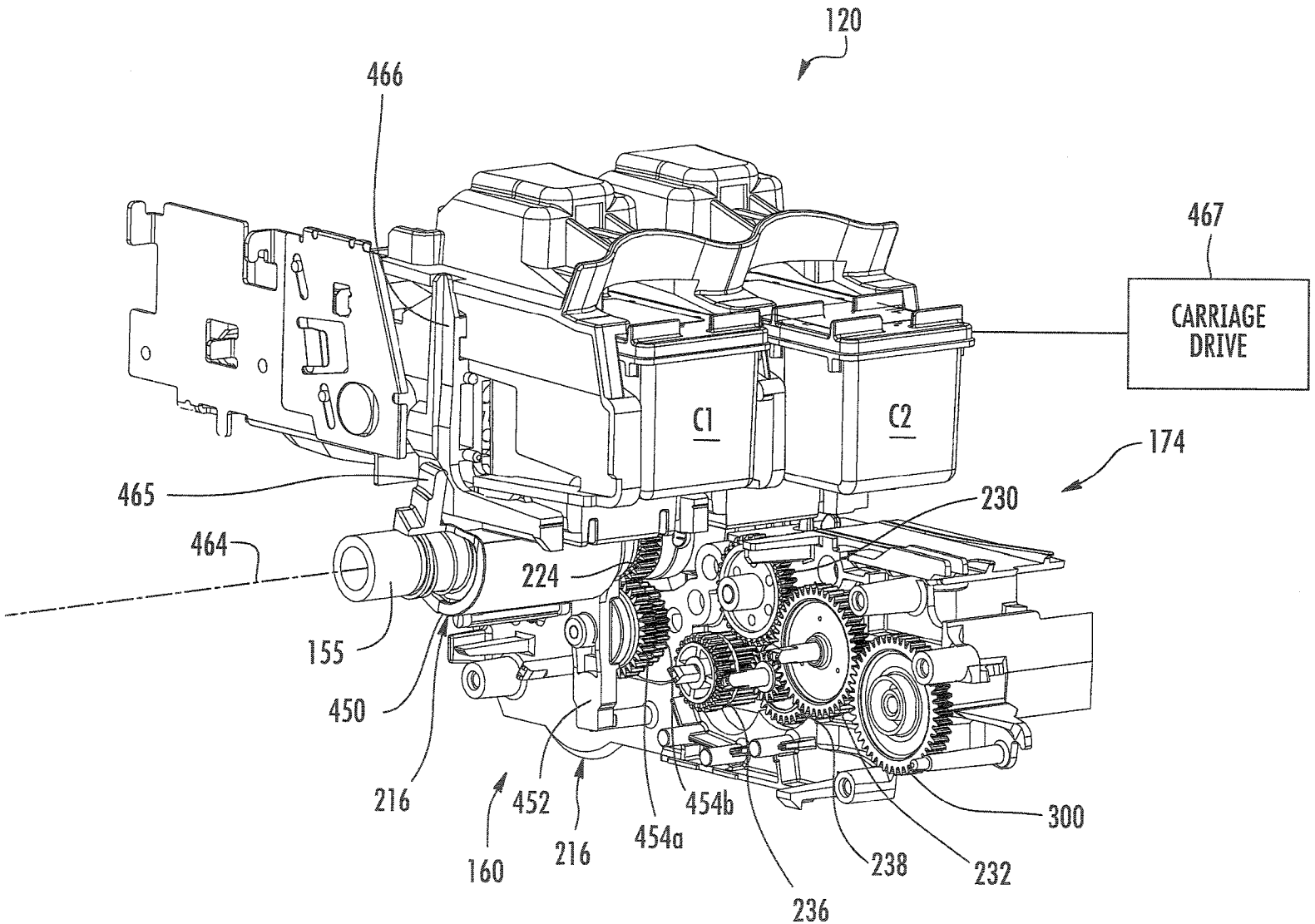
FIG. 6 is a perspective view of the media interaction system of FIG. 2 illustrating a shifter in a second output state according to an example embodiment.
Figure 8:
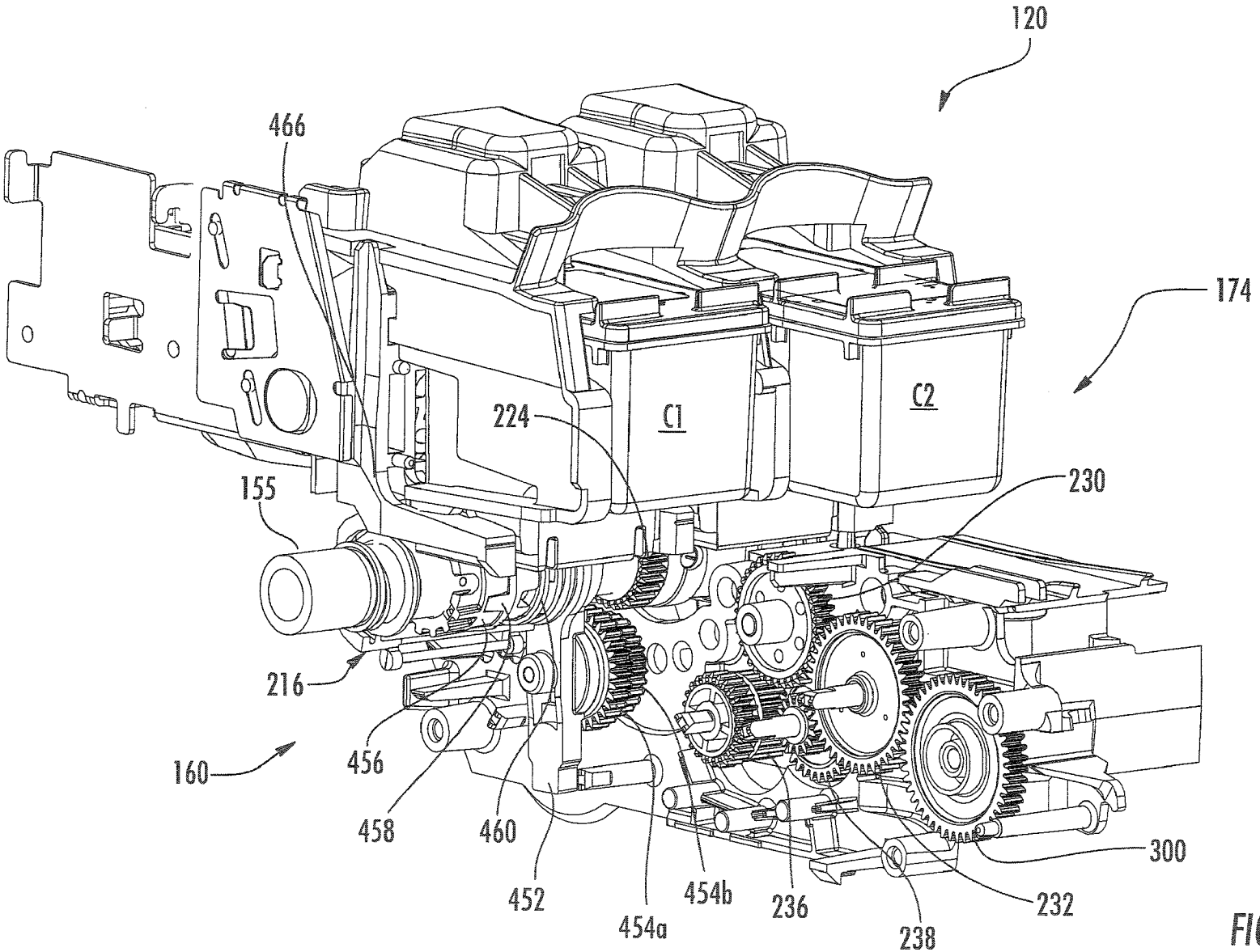
FIG. 8 is a perspective view of the media interaction system of FIG. 7 illustrating a shifter in a shifting state according to an example embodiment.
Figure 9:
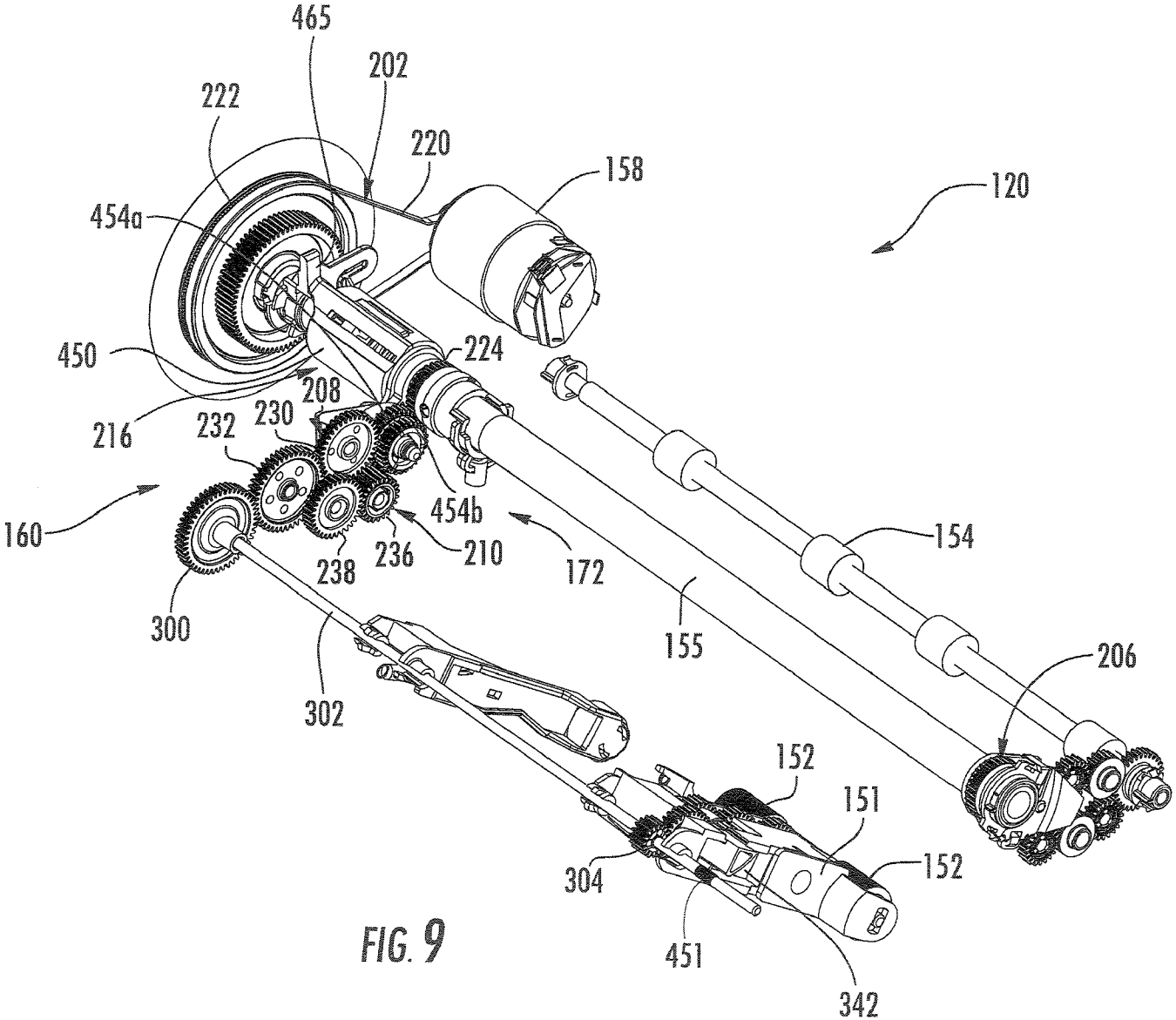
FIG. 9 is a top perspective view of the media interaction system of FIG. 2 illustrating the transmission in a third output state according to an example embodiment.

Shifter 216 is configured to selectively connect feed shaft 155 with either power train 208 or power train 210 or to disengage feed shaft 155 from both power train 208 and power train 210 so as to shift transmission 160 between output states 170, 172 and 174. FIGS. 6-8 illustrates shifter 216 in detail, wherein shifter 216 is shown in output state 174 in which feed shaft 155 is disengaged from both power trains 208 and 210. As shown by FIGS. 6 and 7, shifter 216 includes leash 450 (shown in FIG. 6), swing arm 452, coupling gears 454*a*, 454*b* (collectively referred to as coupling gears 454), clutch member 456, clutch member 458 and bias 460 (shown in FIG. 7). Leash 450 comprises a structure extending about shaft 155 in axial sliding engagement with shaft 155 to guide linear movement of swing arm 452 along an axis 464 of shaft 155 leash 450 further supports swing arm 452.

As shown in FIG. 6, leash 450 includes an extension 465 configured to be engaged by media interaction device 132 (shown in FIG. 2). In particular, extension 465 is configured to be engaged and driven by a carriage 466 which itself is driven by a carriage drive 467 (schematically shown). Carriage 466 supports print cartridges C1 and C2 which include printheads (not shown) and which contain ink. Carriage drive 467 comprises a device configured to move carriage 466, carrying print cartridges C1 and C2, parallel to axis 464 as defined by slider rod (not shown). In one embodiment, carriage drive 467 may include an endless belt (not shown) affixed to carriage 466 and driven to linearly translate carriage 466 along axis 464. In the embodiment illustrated, the carriage drive 467 is used to scan carriage 466 across a medium being printed upon as well as to shift transmission 160. In other embodiments, other mechanisms may be used to actuate shifter 216.

Swing arm 452 comprises a structure non-rotatably coupled to clutch member 458 and rotatably supporting coupling gears 454. Although swing arm 452 is illustrated as including a single swing arm, in other embodiments, swing arm 452 may include more than one arm supporting additional coupling gears 454.

Coupling gears 454 comprises gears rotationally supported by arm 452 and matching with gear 224 of feed shaft 155. Coupling gears 454 are further configured to mesh with either gear 230 of power train 208 or gear 236 of power train 210, depending upon the orientation of swing arm 452. Clear 454*a* is in mesh with gear 224 while gear 454*b* has a one-way clutch connecting it to gear 454*a*. While driving gear 224 in a clockwise direction in figure 3, torque is transmitted to gear 454*b*. When gear 224 is driven in a counter clockwise direction, gear 454*b* is idle. Gear 454*a* meshes with gear 236 while in position 172. Gear 454b meshes with gear 230 while in position 170.

Clutch member 456 comprises a structure non-rotatably coupled to shaft 155 so as to rotate with shaft 155. In the embodiment illustrated, clutch member 456 is also axially fixed to shaft 155. As shown by FIG. 7, clutch member 456 includes axially extending castellations 468 configured to mate with corresponding castellations of clutch member 458. Clutch member 456 may be selectively mated with clutch member 458 to transmit torque.

Clutch member 458 comprises a structure non-rotatably coupled to swing arm 452 such that rotation of clutch member 458 results in rotation of swing arm 452. Clutch member 458 includes castellations 470 configured to intermesh with castellations 468 upon movement of clutch member 458 in the direction indicated by arrow 474 along axis 464. Clutch member 458 is contained within leash 450 such that axial movement of leash 450 in the direction indicated by arrow 474 compresses bias 460, which is a compression spring between leash 450 and clutch member 458, to move clutch member 458 from the disengaged position (shown in FIG. 7) to the engaged position (shown in FIG. 8). When clutch member 458 is in the engaged position, coupling gears 454 are out of engagement with both gear 230 and gear 236, permitting swing arm 452 to be rotated about axis 464. When clutch member 458 is in the engaged position, clutch members 456 and 458 are interlocked such that rotation of feed shaft 155 results in the swing arm 452 being rotated to reposition coupling gears 454 to a desired angular orientation about axis 464 to actuate transmission 160 to one of output states 170, 172 and 174.

FIG. 3 illustrates transmission 160 in output state 170. In output state 170, coupling gears 454 are positioned by swing arm 452 in intermeshing engagement with gear 224 of feed shaft 155 and gear 230 of power train 208. As a result, torque from motor 158 drives pick tire 152 and take away shaft 154 in the same direction while driving the feed shaft 155 in the opposite direction. When motor 158 supplies torque in a first direction, pick tire 152 is rotationally driven in a counterclockwise direction (as seen in FIG. 3) while feed shaft 155 is driven in a clockwise direction as seen in the FIG. 3. As a result, a sheet is driven into abutment with feed shaft 155 and squared. In response to signals from a sensor or based upon encoder signals associated with motor 158, controller 62 generates control signals reversing the direction of motor 158. As a result, torque is transmitted by transmission 160 such that feed shaft 155 is subsequently driven in a counterclockwise direction to feed the sheet along media feed path 136 (shown in FIG. 2) while pick tire 152 is idling as a result of a one-way clutch 454.

Should faster feeding of sheets be desired, a person may enter an appropriate command via command interface 61. In response to such commands, controller 62 generates control signals directing carriage drive 467 to move carriage 466 into engagement with extension 465 of leash 450 (shown in FIG. 6). Carriage 466 is driven along axis 464 until clutch member 458 is moved to the engaged position in which clutch member 458 meshes with clutch member 456 and in which coupling gear 454 is out of engagement with gear 230 of power train 208. Thereafter, controller 62 may generate control signals directing motor 158 to rotationally drive shaft 155 so as to reposition swing arm 452 and coupling gear 454 across from and in substantial alignment with gear 236 of power train 210. Once appropriately positioned, controller 62 generates control signals directing carriage drive 467 to move carriage 466 in the direction indicated by arrow 475 in FIG. 7, permitting bias 460 to move swing arm 452 and coupling gear 454 in the direction indicated by arrow 475 into meshing engagement with gear 236. As a result, transmission 160 is shifted to output state 172 (shown in FIG. 9). Controller 62 further generates control signals directing motor 158 to supply torque to feed shaft 155 which now results in transmission 160 rotationally driving pick tire 152, take away shaft 154 and feed shaft 155 in the same direction, with pick tire 152 and take away shaft 154 being driven at different surface speeds. As noted above, the speeds are chosen such that a reliable and consistent gap is formed between consecutive sheets. As a result, time is not consumed between the picking of consecutive sheets to reverse the motor and sheets may be picked and driven at a faster rate.

Figure 10:
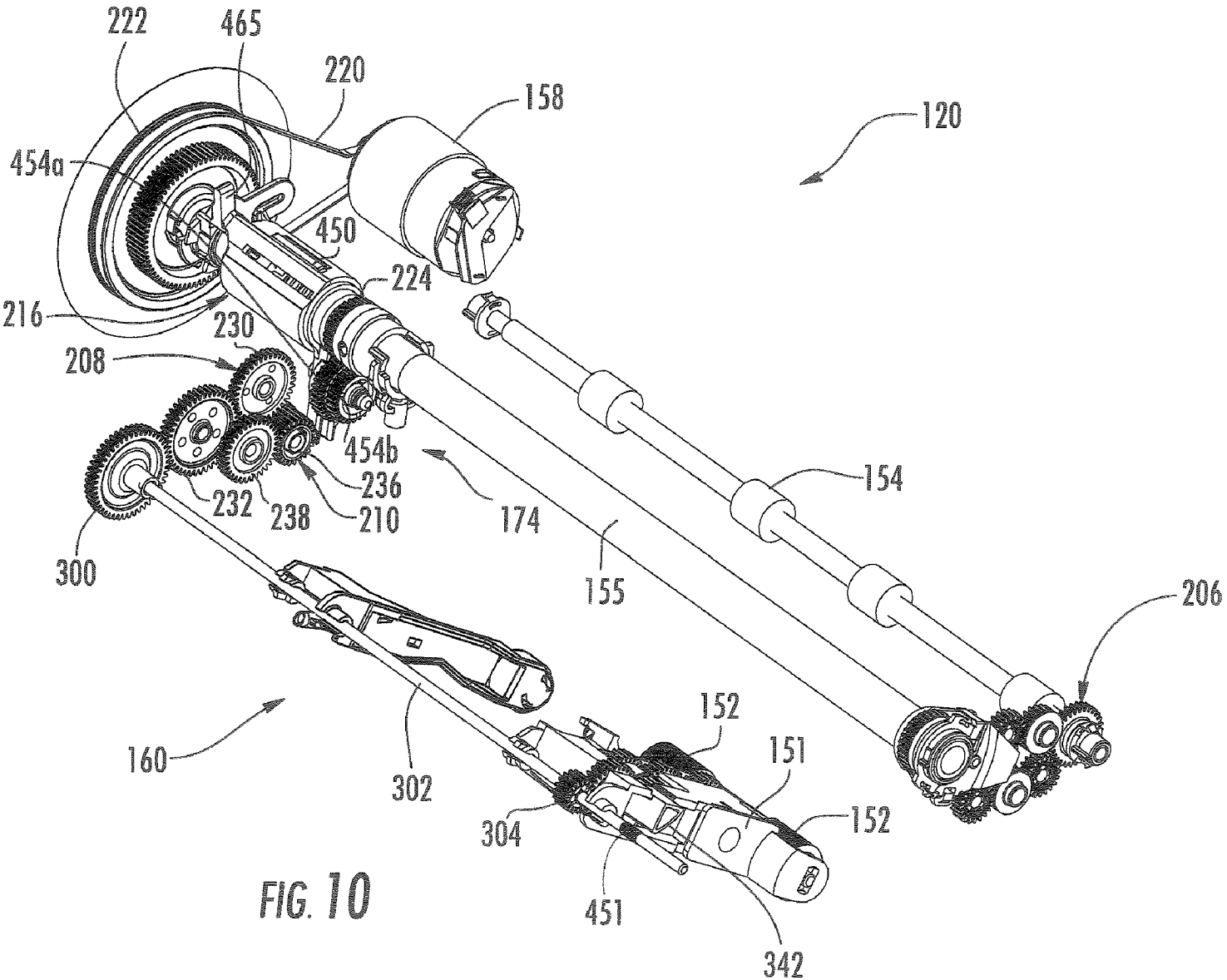
FIG. 10 is a top perspective view of the media interaction system of FIG. 2 illustrating the transmission in the second output state according to an example embodiment.

Upon a final sheet being picked, as determined by controller 62 from print instructions indicating the number of pages to be printed, controller 62 may generate control signals shifting transmission 160 to output state 174 shown in FIG. 10. Shifting transmission 160 to output state 174 is substantially similar to the process described above for shifting from output state 170 to output state 172 except that swing arm 452 is rotated such that coupling gears 454 are not in engagement with either of power train 208 nor power train 210 as shown in FIG. 7. As a result, torque supplied to feed shaft 155 by motor 158 continues to drive take away shaft 154 and feed shaft 155 to transfer the last sheet along media path 136 (shown in FIG. 2). At the same time, torque is not transmitted to pick tire 152. Although pick tire 152 may remain in contact with a topmost sheet of the stack, the sheet is not driven. Consequently, an extra sheet is not picked.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible.

For example, unless specifically otherwise noted, the claims reciting a single particular element also encompass a plurality of such particular elements.

What is claimed is:

1. An apparatus comprising:

a separation system comprising:

a motor;

a pick tire;

a take-away shaft; and a transmission operably coupled between the drive motor and each of the pick tire and the take-away shaft, wherein the transmission is configured to operate in a first output state in which torque is transmitted from the motor to the pick tire and the take-away shaft to concurrently rotate the pick tire in a first feed direction at a first surface speed while in engagement with a media sheet and the take-away shaft in the first feed direction at a second greater surface speed and in a second output state in which the pick tire is out of driving engagement with the media sheet, wherein the system is configured to consecutively pick a plurality of sheets while in the first state and without changing from the first output state and wherein the transmission, in the second output state, transmits torque from the motor to the pick tire and the take-away shaft to concurrently rotate the pick tire in a second direction opposite to the first feed direction and the take-away shaft in the first feed direction.

2. The apparatus of claim 1, wherein the pick tire and the take-away shaft are rotated at substantially similar surface speeds when the transmission is in the second output state.

3. The apparatus of claim 1, wherein the transmission is configured to be selectively operated in a third output state in which no torque is transmitted to the pick tire and which torque is transmitted from the motor to the take-away shaft to rotate the take-away shaft in the first feed direction.

4. The apparatus of claim 1, wherein the transmission, in the second output state, transmits torque to the pick tire and which torque is transmitted from the motor to the take-away shaft to rotate the take-away shaft in the first feed direction.

5. The apparatus of claim 1, wherein the pick tire and the take-away shaft are operated at different surface speeds in the first output state such that sequential sheets exiting the take-away shaft are spaced by a separation distance of at least 30 mm.

6. The apparatus of claim 1 further comprising:

a media interaction device;

a media path extending between the take-away shaft and the media interaction device; and a mechanical flag configured to move in response to being contacted by a sheet moving along the path, wherein the pick tire and the take-away shaft are operated at different surface speeds in the first output state such that sequential sheets contact the flag at least about 20 ms apart from one another.

7. The apparatus of claim 1 further comprising a non-transmissive sensor configured to detect a leading edge of a sheet after the sheet has exited the take-away shaft.

8. The apparatus of claim 1 further comprising a print device configured to print adjacent to a trailing edge of a sheet advanced by the take-away shaft.

9. The apparatus of claim 1 further comprising:

a media interaction device;

a first media path extending from the take-away shaft to the media interaction device;

a second media path extending from the first media path; and a diverter configured to selectively divert media from the first media path to the second media path.

10. The apparatus of claim 1 further comprising a feed shaft, wherein the transmission is configured to selectively transmit torque to the feed shaft to rotate the feed shaft in a direction opposite to the first feed direction to move a trailing edge of a sheet against the take-away shaft.

11. The apparatus of claim 1, further comprising an angled separation wall between the pick tire and the take-away shaft.

12. A method comprising:

picking a first sheet from a stack with a pick tire driven by a motor at a first surface speed in a first direction;

feeding the first sheet from the pick tire with a take-away shaft driven in the first direction by the motor at a second surface speed greater than the first surface speed as the motor drives the pick tire in the first direction to pick a second sheet of the stack; and feeding the second sheet from the pick tire with the take-away shaft driven in the first direction by the motor while the pick tire is out of driving engagement with a third sheet of the stack, wherein the motor does not change direction between initiation of the picking of the first sheet and initiation of the pick of the second sheet.

13. The method of claim 12, wherein the pick tire and the take-away shaft are both driven in the first direction while a transmission coupling the motor to the pick tire and the take-away shaft is in a first output state and wherein the method further comprises actuating the transmission to a second output state in which torque is transmitted from the motor to the pick tire and the take-away shaft to concurrently rotate the pick tire in a second direction opposite to the first feed direction and the take-away shaft in the first direction.

14. The method of claim 13 further comprising actuating the transmission to a third output state in which no torque is transmitted to the pick tire and in which torque is transmitted from the motor to the take-away shaft to rotate the take-away shaft in the first feed direction.

15. The method of claim 12 wherein the pick tire and the take-away shaft are both driven in the first direction while the transmission coupling the motor to the pick tire and the take-away shaft is in a first output state and wherein the method further comprises actuating the transmission to a second output state in which no torque is transmitted to the pick tire and in which torque is transmitted from the motor to the take-away shaft to rotate the take-away shaft in the first feed direction.

16. The method of claim 12, wherein the pick tire and the take-away shaft are operated at different surface speeds such that sequential sheets exiting the take-away shaft are spaced by a separation distance of at least 30 mm.

17. The method of claim 12 further comprising printing along a trailing edge.

18. The method of claim 12 further comprising moving a first sheet in a reverse direction along a media path into abutment with a squaring surface while a second consecutive sheet is being driven in a forward direction.

19. The apparatus of claim 1, wherein the system is configured to consecutively pick the plurality of the sheets without changing direction of the motor between the picking of the plurality of sheets.

20. The apparatus of claim 1 further comprising a carriage carrying print cartridges, the carriage being movable to shift the transmission between the first state and the second state.

21. The apparatus of claim 1, wherein the pick tire is out of driving engagement with the media sheet when the transmission is in the second output state and when the motor is driving in a first motor driving direction and wherein the pick tire is concurrently rotated in the second direction while the take away shaft is rotated in the first direction in the second state when the motor is driving in a second motor driving direction opposite to the first motor driving direction.

22. An apparatus comprising:

a separation system comprising:

a motor;

a pick tire;

a take-away shaft; and a transmission operably coupled between the drive motor and each of the pick tire and the take-away shaft, wherein the transmission is configured to operate in a first output state in which torque is transmitted from the motor to the pick tire and the take-away shaft to concurrently rotate the pick tire in a first feed direction at a first surface speed while in engagement with a medium and the take-away shaft in the first feed direction at a second greater surface speed and in a second output state in which the pick tire is out of driving engagement with the medium, wherein the transmission, in the second output state, transmits torque from the motor to the pick tire and the take-away shaft to concurrently rotate the pick tire in a second direction opposite to the first feed direction and the take-away shaft in the first feed direction.

23. The apparatus of claim 22, wherein the pick tire and the take-away shaft are rotated at substantially similar surface speeds when the transmission is in the second output state.

* * * * *

UNITED STATES PATENT AND TRADEMARK OFFICE

CERTIFICATE OF CORRECTION

PATENT NO. : 7,594,652 B2
APPLICATION NO. : 11/669930
DATED : September 29, 2009
INVENTOR(S) : Wesley R. Schalk et al.

It is certified that error appears in the above-identified patent and that said Letters Patent is hereby corrected as shown below:

In column 8, line 13, after "non-transmissive" delete "a".

In column 17, line 33, in Claim 3, after "and" insert -- in --.

In column 17, line 37, in Claim 4, after "and" insert -- in --.

Signed and Sealed this

Sixteenth Day of November, 2010

David J. Kappos

David J. Kappos
*Director of the United States Patent and Trademark Office*